United States Patent [19]

Smith

[11] 4,213,205

[45] Jul. 22, 1980

[54] SKI MITTEN

[76] Inventor: Nancy O. Smith, 191 Hill Brook La., Fairfield, Conn. 06430

[21] Appl. No.: 933,096

[22] Filed: Aug. 11, 1978

[51] Int. Cl.[2] ..... A41D 19/00; A14D 13/08

[52] U.S. Cl. ..... 2/161 A; 2/16

[58] Field of Search ..... 2/16, 17, 158, 161 A; 280/11.37 B, 11.37 D, 11.37 E, 11.37 H

[56] References Cited

FOREIGN PATENT DOCUMENTS

| | | | |
|---|---|---|---|
| 1388019 | 12/1964 | France | 2/17 |
| 64415 | 12/1942 | Norway | 2/158 |
| 154151 | 7/1932 | Switzerland | 2/17 |
| 955041 | 4/1964 | United Kingdom | 2/17 |

*Primary Examiner*—Werner H. Schroeder
*Assistant Examiner*—Doris L. Troutman
*Attorney, Agent, or Firm*—Parmelee, Johnson, Bollinger & Bramblett

[57] ABSTRACT

A ski mitten is disclosed comprising a cuff of flexible material for encircling the wrist with a thumbless enclosure of flexible hand-protecting material extending forwardly from this cuff and having a rounded configuration of sufficient size to enclose the whole hand when grasping the handle of a ski pole. The mitten enclosure has an aperture in the bottom permitting the shank of the ski pole to extend out of the mitten while the handle is being held. The flexible material surrounding the aperture is sufficiently flexible and stretchable to enable the whole mitten to be retracted in a quick motion over the wrist for exposing the hand whenever the user may wish. Accordingly, the mitten remains conveniently available on the wrist, avoiding a chance of loss, and is ready to be repositioned over the whole hand whenever there are changes in weather conditions or exercise level. The thumbless mitten has a rounded triangular configuration as seen in side elevation, with the cuff being positioned at an apex and the aperture for the ski pole shank located along one side of the triangular configuration near the cuff. This mitten is particularly adapted to be worn during cross-country skiing, and it may also be employed to advantage by a downhill skier.

9 Claims, 3 Drawing Figures

SKI MITTEN

DESCRIPTION

The present invention is in the field of ski mittens and more particularly relates to a thumbless mitten adapted to enclose and protect the user's whole hand while the user is holding the handle of a ski pole and also adapted to be retracted over the user's wrist where the mitten is in readiness to be repositioned over the whole hand whenever desired.

The sport of skiing and in particular cross-country skiing provides vigorous exercise for the participant. Moreover, as the skier progresses during the day, there are changes in terrain, wind and weather conditions which may call for quickly and fairly frequently increasing or decreasing the amount of protective clothing required to be worn.

At the start of the day, temperature is low, snow is crisp, and the skier is not yet warmed up. Extensive amounts of protective clothing are needed, including hand protection. There may begin a long period of steady uphill climbing, during which the exercise is sustained at a vigorous level. The skier needs to peel off clothing and ultimately to remove the hand protection to prevent undue perspiring. At another time, the cross-country skier is sliding downhill against a biting head wind. The hands require protection against the cutting chill. Then, there is a need to remove the hand protection for adjusting equipment or taking a photograph, and so forth.

Also, in downhill skiing, particularly during spring conditions, there is often a need to remove or replace hand protective covering at frequent intervals. There is a need for hand protection during the early morning or late afternoon periods on slopes where stiff headwinds are encountered or on windy lifts, but there are intervals when exercise and warm weather, need to adjust equipment, etc., call for removal of the hand covering.

In spite of the fact that these factors of changing weather and terrain conditions and changing exercise levels are well known in the skiing industry, there has not been a satisfactory solution to the skier's problem of frequent removal and replacement of hand covering. Certain conventional mittens have snap hooks or other attachments so that they can be temporarily attached to the skier's belt when not in use, or else the removed mitten must be stuffed into a pocket or pack. There is always the risk that the skier will drop or lose the removed hand covering. This means there is an anguished period of back tracking to find the missing item. If the removed mitten was accidentally dropped from a lift, the result can be a severely chilled or frost bitten hand, unless the skier can borrow hand protection or use a scarf as a temporary expedient.

When a family is out for a day of cross-country recreation, the probability that one or more of the children will lose a mitten is so high that one of the adults is likely to bear the burden of carrying an extra pair "just in case". Even so, the adults keep a conscious check to try to avoid the loss of mittens, because the cost of such equipment is a significant factor in the family's budget.

The present invention solves the problem of enabling the skier to remove and replace hand covering quickly and easily. This invention enables the removed mitten to be temporarily stored on the skier's wrist where it cannot be lost and where it is immediately available on a moments notice. The removed mitten is always in a known location. Thus, it can be pulled forward and down over the whole hand, while the skier continues ahead without diverting vision from the trail ahead.

In the case of snap hooks, they sometimes act balky. They usually require that the skier stop moving and direct full attention onto the sequential details of planting the pole, unsnapping the mitten, and replacing it onto the hand, and then picking up the pole before starting onward.

Among the advantages of the present invention are those resulting from the fact that the thumbless mitten is adapted to enclose the whole hand when grasping the handle of a ski pole. Thus, the user obtains a responsive "feel" of pole placement and handling, because the hand itself is directly grasping the handle. The thumb, fingers and palm are directly grasping the handle. This direct hand grasp onto the pole handle is quite different from the conventional situation where the layers of a bulky mitten intervene and deaden the sensations of pole handling.

Further advantages result from the fact that the ski mitten can be removed from the hand to be retracted over the wrist in one easy, quick continuous movement, and also can be replaced over the hand in one quick, continuous easy movement, while the skier keeps going, without completely releasing the hand grasp on either of the poles. This convenience is distinctly different from the case with conventional mittens in which the user must stop and completely release the handle of each ski pole in turn as the mittens are removed or as they are replaced.

A ski mitten embodying this invention can be utilized to great advantage by cross-country ski enthusiasts and may also be used by downhill skiers.

By virtue of the fact that the whole hand is enclosed together in a thumbless enclosure, the fingers and thumb help to warm each other.

BRIEF DESCRIPTION OF THE DRAWINGS

The foregoing and other objects, features, aspects and advantages of the invention will be apparent from the following more particular description of a preferred embodiment of the invention, as illustrated in the accompanying drawings, in which like reference characters refer to the same parts throughout the different views. The drawings are not necessarily to scale, emphasis instead being placed upon illustrating the principles of the invention.

Figure 1:
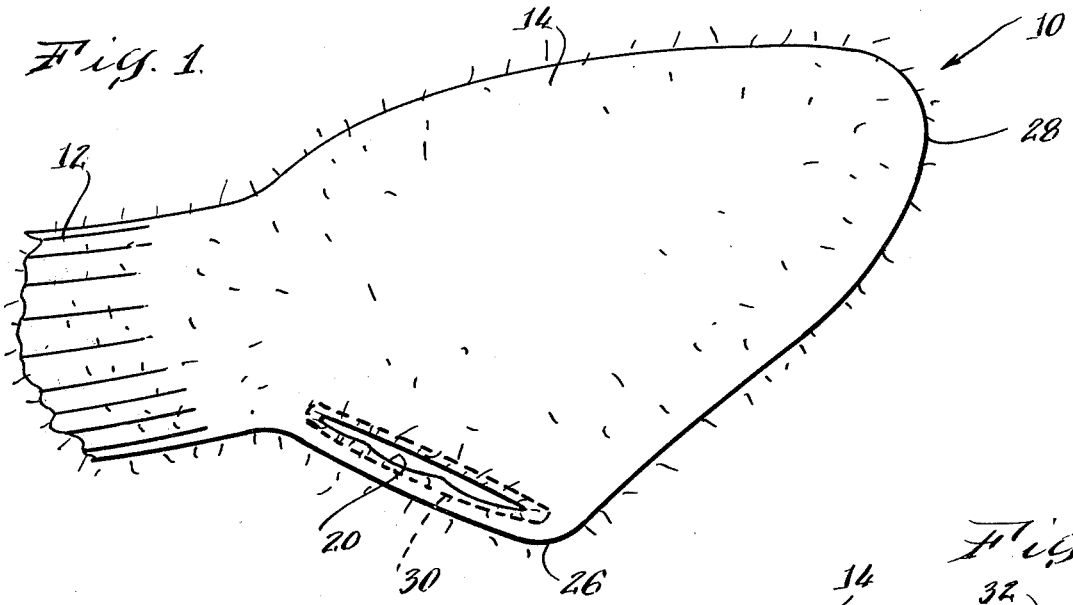
FIG. 1 is a side elevational view of a ski mitten embodying the present invention.

The ski mitten 10 includes a cuff 12 of flexible material for encircling and protecting the user's wrist from cold weather. This cuff may be formed of flexible material, for example, of knitted or woven fabric or pleated material. The cuff may include a lining of thermally insulative material with a durable weatherproof covering. The cuff usually includes elastic bands or a draw string, or is stretchably knitted for fitting snugly about the user's wrist when the cuff is in position for use. The cuff is also sufficiently flexible and stretchable to be slipped over the hand into wearing position on the wrist as seen in FIG. 2.

Extending forwardly from the cuff 12 is a thumbless enclosure 14 of flexible hand-protecting material and having a rounded configuration of sufficient size to enclose the whole hand when grasping the handle 16 of a ski pole 18. The hand enclosure 14 includes an aperture 20 in the bottom for permitting the shank 22 of the ski pole to extend out of the mitten while the handle is grasped. The handle 16 may include a strap 24 or similar strap-like member which partially or completely encircles the user's hand for providing a secure hand hold onto the handle. The hand enclosure 14 of the mitten is shown as being sufficiently large to enclose such a hand grip member 24.

The hand enclosure 14 is formed of flexible, hand-protecting material, for example, of knitted or woven fabric, and may include a lining of thermally insulative material with a durable weatherproof covering.

Figure 2:
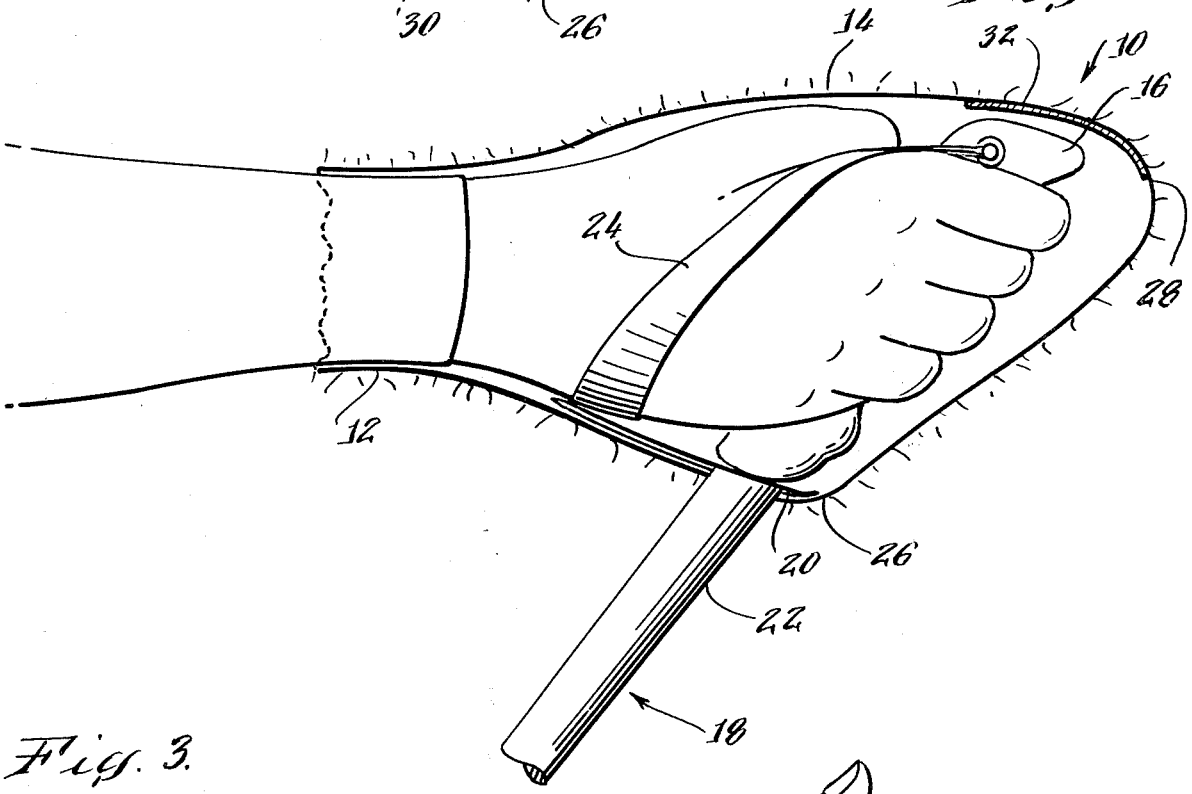
FIG. 2 shows the location of the skier's whole hand within the mitten enclosure while holding the handle of a ski pole.

As seen in FIGS. 1 and 2, the mitten enclosure 14 has a generally rounded triangular configuration with a rounded vertex 26 at the forward bottom and a rounded vertex 28 at the forward top. The cuff 12 is located at the rear vertex of this rounded triangular configuration.

Figure 3:
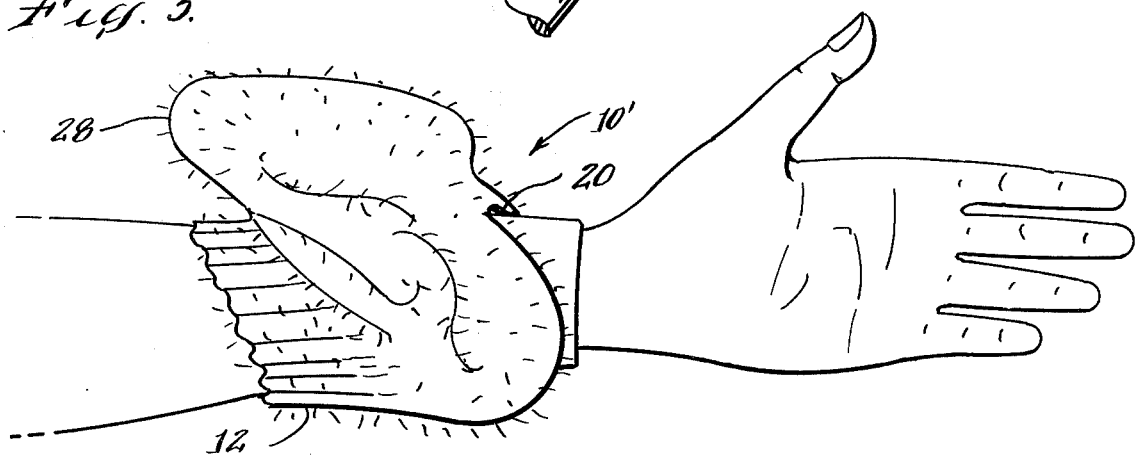
FIG. 3 illustrates the convenient retraction of the removed mitten over the user's wrist.

The aparture 20 is shown extending along the bottom side of this triangle and is located between the cuff and the vertex 26. It is the preferred mode of practising this invention that relatively strong elasticity, as shown by dashed line 30, be provided closely surrounding the aperture 20 in the material of the hand enclosure 14. This elasticity serves to keep the aperture 20 effectively closed about the pole shank for excluding the wind when the mitten is being worn as shown in FIG. 2. Moreover, this elasticity 30 facilitates quick removal of the mitten and retraction onto the wrist, as shown in FIG. 3. Thus, the mitten is temporarily stored on the wrist, exposing the hand for appropriate thermal condition or for adjusting equipment, taking a photograph, etc. The retracted mitten 10' is conveniently accessible for quick and easy replacement onto the hand. A forward pull on the vertex 28 with a slight downward movement replaces the retracted mitten onto the whole hand.

As shown in FIG. 2, a wear-resistant reinforcing pad 32 is preferred to be included inside of the hand enclosure 14 at the top near the end of the handle 16. This reinforcement 32 is shown located immediately rearwardly from the rounded vertex 28.

It is also preferred that the ski pole handle 16 be formed of material effectively thermally insulative for preventing undue heat loss from the hand into the pole shank 22.

While a particular embodiment of this invention has been shown and described, it is not intended to limit the same to the details of the construction set forth, but instead, the invention embraces such changes, modifications and equivalents of the various parts and their relationships as come within the purview of the appended claims.

I claim:

1. A ski mitten comprising:

a cuff of flexible material for encircling the wrist, a thumbless enclosure of flexible hand-protecting material extending forwardly from said cuff having a rounded configuration of sufficient size to enclose the whole hand when the hand is grasping the handle of a ski pole, said enclosure having an aperture in the bottom for permitting the shank of the ski pole to extend out of the bottom of the mitten while the pole handle is being held in normal position for use during skiing with the shank of the pole extending downwardly and rearwardly relative to the hand and wrist of the user, and the flexible material surrounding said aperture being sufficiently flexible and stretchable for enabling the mitten to be retracted into a position over the wrist by projecting the whole hand out through said aperture for exposing the whole hand whenever the user wishes, whereby the mitten remains conveniently available on the wrist, avoiding a chance of loss, and ready to be repositioned over the whole hand whenever desired without releasing the pole handle from the hand.

2. A ski mitten as claimed in claim 1, in which:

there is elastic means incorporated into the hand-protecting material surrounding said aperture for keeping the aperture effectively closed about the protruding pole shank when said ski mitten is in its normal position enclosing the whole hand while the hand is grasping the handle of said ski pole in normal position for use.

3. A ski mitten as claimed in claim 1, in which:

said thumbless enclosure is sufficiently large for enclosing the whole hand when the hand is grasping the handle of a ski pole and is also sufficiently large to enclose a hand strap or similar hand-hold member which is incorporated with the pole handle and which at least partially encircles the hand.

4. A ski mitten as claimed in claim 2, in which:

said thumbless enclosure is sufficiently large to enclose a hand strap or similar hand-hold member encircling the hand while the hand grasps the pole handle.

5. A ski mitten as claimed in claim 1, in which:

said thumbless enclosure has reinforcement therein located in the upper portion above the position of the top end of the pole handle when grasped by the hand within said enclosure.

6. A ski mitten comprising:

a cuff of flexible material for encircling the wrist, a thumbless enclosure of flexible hand-protecting material extending forwardly from said cuff having a rounded configuration of sufficient size to enclose the whole hand when grasping the handle of a ski pole, said enclosure as seen in side view with the hand in its normal position grasping the pole handle, with the pole shank extending downwardly and rearwardly, has a generally rounded triangular configuration with a rounded vertex at the forward bottom of the enclosure and a rounded vertex at the forward top of the enclosure and with said cuff being located at the rear vertex of this rounded triangular configuration, said enclosure having an aperture in the bottom for permitting the shank of the ski pole to extend out of the mitten while the pole handle is being held in said normal position, and the flexible material surrounding said aperture being sufficiently flexible and stretchable for enabling the whole mitten to be retracted over the wrist by projecting the whole hand out through said stretchable aperture for exposing the whole hand whenever the user wishes, whereby the mitten remains conveniently available on the wrist, avoiding a chance of loss, and ready to be repositioned over the whole hand whenever desired without releasing the pole handle from its grasp by the hand.

7. A ski mitten as claimed in claim 6, in which:

said aperture extends along the bottom side of said rounded triangular configuration located between the cuff and said forward bottom vertex.

8. A ski mitten as claimed in claim 7, in which:

elastic means in said hand-protecting material encircles said aperture for holding the hand-protecting material effectively closed about the pole shank for protecting the hand from weather when said ski mitten is in position enclosing the whole hand while the hand is grasping the ski pole handle in said normal position.

9. A ski mitten as claimed in claim 6, in which:

reinforcement means is included in said enclosure in the upper portion thereof at least in the vicinity of said top forward rounded vertex in position for providing protection for the enclosure against possible wearing action by the top of the pole handle.

* * * * *